US006463251B2

(12) United States Patent
Kiuchi

(10) Patent No.: US 6,463,251 B2
(45) Date of Patent: Oct. 8, 2002

(54) FIXING DEVICE AND AN IMAGE FORMING APPARATUS USING THE FIXING DEVICE

(75) Inventor: Osamu Kiuchi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/860,594

(22) Filed: May 21, 2001

(65) Prior Publication Data

US 2002/0001481 A1 Jan. 3, 2002

Related U.S. Application Data

(62) Division of application No. 09/431,174, filed on Nov. 1, 1999, now Pat. No. 6,269,230.

(30) Foreign Application Priority Data

Jun. 23, 1998 (JP) ..... 11-176255
Oct. 30, 1998 (JP) ..... 10-310414
Oct. 30, 1998 (JP) ..... 10-310415

(51) Int. Cl.[7] ..... G03G 15/20
(52) U.S. Cl. ..... 399/330; 219/541; 219/216
(58) Field of Search ..... 399/320, 330, 399/122; 219/216, 541, 549, 388, 469

(56) References Cited

U.S. PATENT DOCUMENTS 3,792,227 A * 2/1974 Snowden ..... 219/216
4,493,982 A * 1/1985 Romansky ..... 219/216
4,875,068 A * 10/1989 Pawlik et al. ..... 219/216
5,115,119 A * 5/1992 Adachi et al. ..... 219/216
5,737,664 A * 4/1998 Fukuda et al. ..... 219/216
5,787,319 A * 7/1998 Tomatsu ..... 399/33
6,269,230 B1 * 7/2001 Kiuchi ..... 399/122
6,275,669 B1 * 8/2001 Hasegawa ..... 399/330

FOREIGN PATENT DOCUMENTS

JP 02253284 A * 10/1990 ..... G03G/15/20
JP 04267281 A * 9/1992 ..... G03G/15/20
JP 08272239 A * 10/1996 ..... G03G/15/20

* cited by examiner

*Primary Examiner*—Robert Beatty
(74) *Attorney, Agent, or Firm*—Oblon, Spivak, McClelland, Maier & Neustadt, P.C.

(57) ABSTRACT

A fixing device includes a housing, a heat roller configured to be rotatably supported by bearings and a pressure roller configured to be located downward relative to the heat roller. The heat roller includes a heater having lead wires extending from each end of the heater, heater terminals provided at each end of the lead wires wherein the heater terminals have a connecting portion extending in the longitudinal direction of the heater and an attachment portion extending perpendicular to the longitudinal direction of the heater and fixedly attached to the housing at a fixing position. A flexible space formed on at least one of the fixing positions of the heater with the housing allows the heater terminal to bend along the longitudinal direction of the heater.

15 Claims, 11 Drawing Sheets

FIXING DEVICE AND AN IMAGE FORMING APPARATUS USING THE FIXING DEVICE

BACKGROUND OF THE INVENTION

1. Field of the Invention

The present invention relates to a fixing device and an image forming apparatus using the fixing device. More particularly, the present invention relates to a fixing device including a heat roller supported by bearings.

2. Discussion of the Background

In image forming apparatuses, such as copying machines, printers, and the like, there is known an image forming apparatus provided with a fixing device that conveys a transfer sheet while nipping the transfer sheet with a heat roller and a pressure roller to affix a toner image on the transfer sheet, which is transferred onto the transfer sheet from a photoconductor drum. Namely, heat and pressure are applied to the transfer sheet in the sheet conveying process by the fixing device to affix the toner image on the transfer sheet.

A known fixing device illustrated in FIG. 11 is an example of such a fixing device. In the fixing device illustrated in FIG. 11, an elastic piece 103 having claw-shaped hooks 102 on respective upper ends is formed in a body of a C-shaped bearing 101 by which each end of a heat roller 100 is rotatably supported. The bearing 101 is secured to a supporting member 104 such as a housing by the hooks 102 elastically hooked to the supporting member 104.

When the fixing device is constructed, at first the bearing 101 is secured to the supporting member 104, and the heat roller 100 is fit into the bearing 101, by elastically expanding a distance between both ends of the bearing 101. Then, the pressure roller 105 is brought into contact with the heat roller 100.

The operation fitting the heat roller 100 into the bearing 101 is performed by pressing the heat roller 100 in a direction orthogonal to the axis of rotation of the heat roller 100. Thus, the fixing device is intended to be easily and automatically constructed.

In a fixing device having a heat roller and a pressure roller, a heater is generally provided inside the heat roller, and the heat roller and the pressure roller are set in a housing. The heater is composed of a quartz glass tube, both ends of which are sealed, and a heat wire provided in the quartz glass tube. The heater is further composed of a lead wire, an end of which is connected to the heat wire through a metal foil and the other end of which extends from the quartz glass tube, and the like parts. A heater terminal is connected to the other end of the lead wire that extends from the quartz glass tube and is affixed to the housing by a screw. A wire harness, which supplies electric power to the heater, is connected to the heater terminal.

Since the fixing device emits a large amount of heat, the housing is required to have thermostability and rigidity and is made of glass-containing synthetic resin. It is a current trend that the bearing is also made of a synthetic resin for the purposes of cost-reduction and weight-reduction. However, in fact the bearing is generally made of expensive synthetic resin, such as PPS (polyphenylene sulfide).

In addition, the heat roller is charged with static electricity generated by friction between the heat roller and the transfer sheet. Therefore, the heat roller is made of electric conductive material, such as metal, or the like. In order to ground the static electricity stored in the heat roller through the bearing, the bearing is also required to be electroconductive.

Accordingly, the material used in the bearing becomes more and more expensive.

In FIG. 11, when the bearing 101 is attached to or detached from the supporting member 104, the elastic piece 103 has to be bent to be hooked to the supporting member 104. Therefore, the length of the elastic piece 103 must be relatively long so that the elastic piece 103 becomes flexible. An amount of the material necessary to form a bearing 101 thereby increases resulting in increase manufacture costs.

Further, the heater generates a relatively large amount of heat when image forming operations are performed. Therefore the housing is expanded by the heat, and the heater terminals affixed to the housing tend to move in such a direction to that the heater terminals pull the lead wires.

Therefore, various problems occur. For example, the heater terminal can become disconnected from the lead wire at the connection part thereof, the metal foil provided in the quartz glass tube can become disconnected from the lead wire at the connection part thereof, and the quartz glass tube can become cracked, thereby damaging the heater.

SUMMARY OF THE INVENTION

Accordingly, an object of the present invention is to provide a fixing device including a bearing to support a heat roller, which has a simple structure so as to be easily assembled, and which is made at a low cost. Another object of the present invention is to provide an image forming apparatus using the fixing device.

Briefly, these objects, and other objects of the present invention as hereinafter will become more readily apparent, can be attained by a novel fixing device that includes a bearing including a C-shaped part; and a projection projected upwardly from a central part of an outer circumferential surface of the C-shaped part, in which the bearing is made of a synthetic resin having elasticity and conductivity, and a distance between both ends of the C-shaped part is elastically expanded. The fixing device further including a heat roller configured to be rotatably supported by the bearing at an upper part of an outer surface of each end of the heat roller in which the outer surface of each end of the heat roller which contacts the bearing, is made of an electroconductive material; a pressure roller configured to be located downward relative to the heat roller and that is driven by being in pressure contact with the heat roller; a housing configured to cover peripheries of the heat roller and the pressure roller and having an inserting part into which the projection of the bearing is detachably inserted from a pressure roller side; and a ground plate configured to attach to the housing and including an elastic piece that detachably hooks the C-shaped part of the bearing, and a ground piece that is grounded.

The housing generally includes an inserting part into which the projection of the bearing is detachably inserted from a pressure roller side, and a hooking pawl that detachably hooks the C-shaped part.

An additional embodiment of the fixing device includes a heat roller including a heater therein; a lead wire configured to extend from each end of the heater; and a heater terminal configured to be provided at each end of the lead wire and which is fixed to the housing, wherein a flexible space in which the heater terminal is capable of bending along a longitudinal direction of the heater is formed on at least one fixing position of the heater with the housing.

A further embodiment of the fixing device includes a heat roller that includes a heater; a thermal fuse configured to be connected to a circuit to supply electricity to the heater and is disposed adjacent to an outer circumference of the heat roller at an opposite side to the pressure roller while keeping an insulation distance between the heat roller and the thermal fuse based on the safety standard; and a thermostable stopper configured to keep an insulation distance between the heat roller and the thermal fuse within such a distance that an insulation strength based on the safety standards is kept even when the bearing melts.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, in which.

DESCRIPTION OF THE PREFERRED EMBODIMENTS

Figure 1:
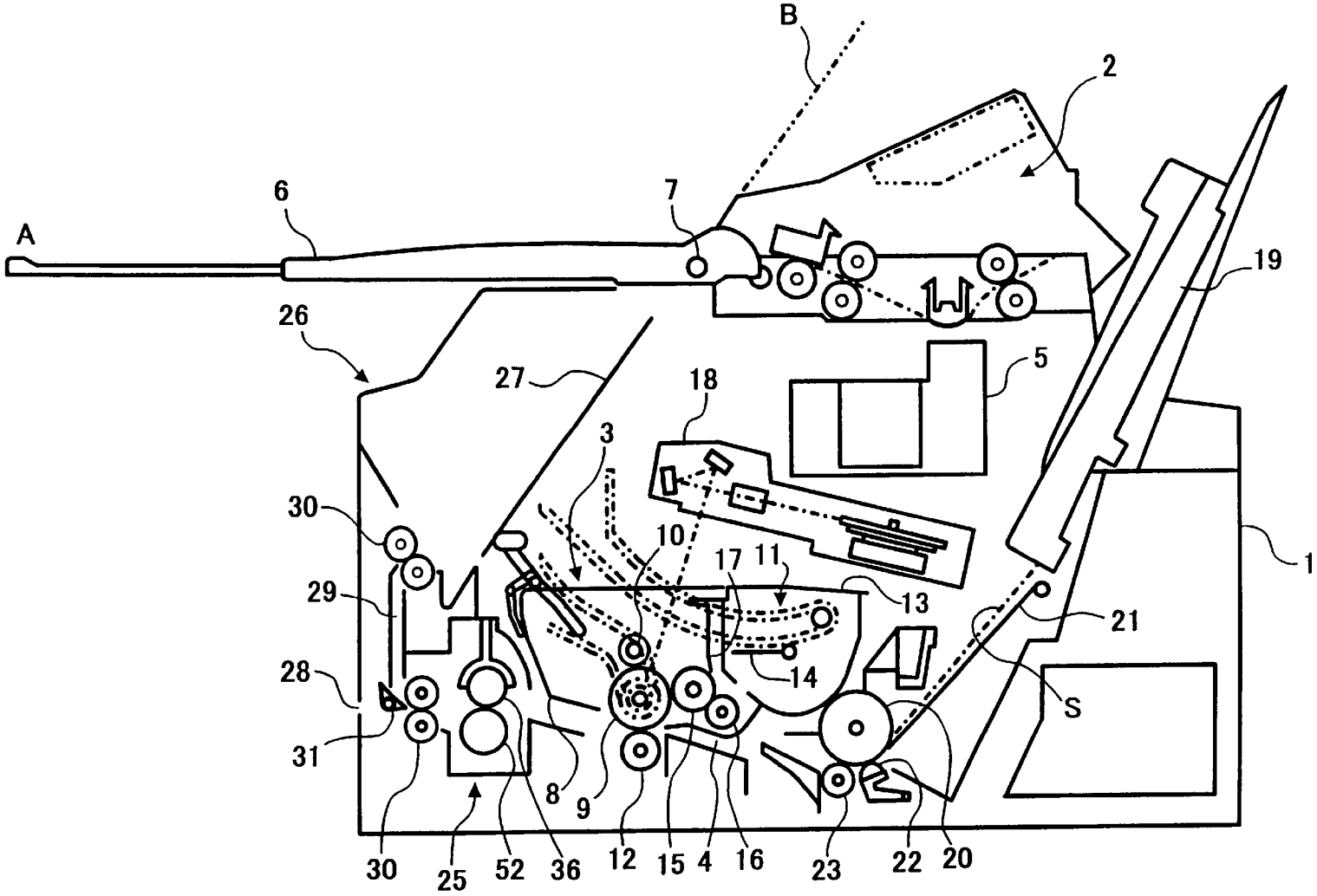
FIG. 1 is a schematic longitudinal section illustrating a structure of an embodiment of the image forming apparatus of the present invention.

The preferred embodiments of the present invention are now described in detail referring to the drawings, wherein like reference numerals indicate identical or corresponding parts throughout the several views.

Referring to FIG. 1 to 5, a first embodiment of the present invention is explained. An internal structure of an image forming apparatus is explained hereinbelow referring to FIG. 1. Numeral 1 denotes a main body of the image forming apparatus having functions of a copying machine, a printer, and a facsimile. An image reading device 2 that reads an image of an original document is mounted on an upper part of the main body 1 of the image forming apparatus. A process cartridge 3 is provided inside the main body 1 of the image forming apparatus. A sheet conveying path 4 that guides a transfer sheet S is formed under the process cartridge 3.

The image reading device 2 includes a reading section 5 that reads an image of an original document and an original tray 6 that stacks the original documents to be fed toward the reading section 5. The original tray 6 is supported so as to be able to rotate around a fulcrum axis 7 from a horizontal position A (current position) to a standing position B that is indicated by a double-dot and a-dash line. In addition, the original tray 6 can be stably positioned at either the horizontal position A or the standing position B by a stopping member (not shown).

In the process cartridge 3, a photoconductor 9 is rotatably provided in a photoconductor case 8, and a charging brush roller 10 to charge a surface of the photoconductor 9 and a developing section 11 are provided in the vicinity of the photoconductor 9. A transfer section 12 is provided at the main body 1 of the image forming apparatus so as to face a lower part of the circumferential surface of the photoconductor 9. The developing section 11 includes a developing case 13, which is detachably provided in the photoconductor case 8, and a rotatable agitator 14 that agitates a developer contained in the developing case 13. The developing section 11 also includes a developing roller 15 that contacts the photoconductor 9, a supply roller 16 that supplies the developer to the developing roller 15, and a blade 17 that contacts the developing roller 15. An optical writing device 18 is provided at an upper part of the process cartridge 3. The optical writing device 18 scans the photoconductor drum 9, which has been charged, with laser light that is modulated on the basis of an image signal to form an electrostatic latent image thereon.

A tray 19 that supports the original document that has been read by the image reading device 2 is provided at one side of the main body 1 of the image forming apparatus. The tray 19 also supports the transfer sheet S that is stacked in an inclined state. In addition, a sheet feed roller 20 that is rotated, and a pressure plate 21 that is biased in a direction to press the transfer sheet S on the tray 19 toward the sheet feed roller 20 are provided under the tray 19. In addition, a separation pad 22 and a separation roller 23 that prevents the transfer sheet S from being double fed by elastically contacting the sheet feed roller 20, respectively, is also provided under the tray 19.

The sheet feeding roller 20, the separation pad 22, and the separation roller 23 are located at an entrance side of the sheet conveying path 4. In addition, a bottom path 24 is connected to the sheet conveying path 4 at a downstream side from the sheet feeding roller 23. Further, a fixing device 25 that fixes the image transferred on the transfer sheet S is provided at a downstream side of the sheet conveying path 4.

Furthermore, a sheet stacker 26 is provided in the main body 1 of the image forming apparatus so as to be disposed between an upper part of the fixing device 25 and the original tray 6. The sheet stacker 26 has a receiving plate 27 that is positioned on an extended surface of the original tray 6 and that supports the transfer sheet S when the original tray 6 is in the standing position B. In addition, a sheet discharge exit 28 that discharges the transfer sheet S, which is discharged from the fixing device 25, in a horizontal direction is formed near a side of the main body 1 of the image forming apparatus, which is opposite to the side of which the tray 19 is provided. Also, a sheet turn-over path 29 that leads the transfer sheet S discharged from the fixing device 25 to the sheet stacker 26 so that the transfer sheet S is turned over is formed near the side of the main body 1 of the image forming apparatus.

Pairs of sheet discharge rollers 30 are disposed at an upper and lower part of the sheet turn-over path 29. In addition, a selecting pick 31 is rotatably mounted at a crossing point of the sheet turn-over path 29 and the sheet discharge exit 28 to switch a discharging direction of the transfer sheet S.

Next, an image reading operation and a printing operation are explained hereinbelow referring to FIG. 1. When the image of the original document is read by the reading section 5, the original document is fed to the reading section 5 while the original tray 6 is kept to be in the horizontal position A. The original document, whose image has been read by the reading section 5 is stacked on the tray 19 in a standing state. The image information thus read can be transmitted to the outside (At this time, the image forming apparatus functions as a facsimile transmission mode). The read image information can also be printed on the transfer sheet S fed from the tray 19 (At this time, the image forming apparatus functions as a copying machine). In addition, the image information transmitted from the outside can also be printed on the transfer sheet S (At this time, the image forming apparatus functions as a facsimile receiving mode).

When the printing operation is performed, the surface of the photoconductor 9 is charged by the charging brush roller 10 while the photoconductor 9 is rotated clockwise. The optical writing device 18 irradiates the surface of the photoconductor 9 with laser light according to the read image information of the original document or the image information sent from the outside, resulting in formation of an electrostatic latent image. The electrostatic latent image is developed by the developing section 11. The developed image is transferred onto the transfer sheet S that is fed from the tray 19 by the sheet feed roller 20. The transferred image is fixed to the transfer sheet S when the transfer sheet S on which the image is transferred passes through the fixing device 25. The transfer sheet S is discharged to either the sheet discharge exit 28 or the sheet stacker 26 depending on the direction of the selecting pick 31.

Figure 2:
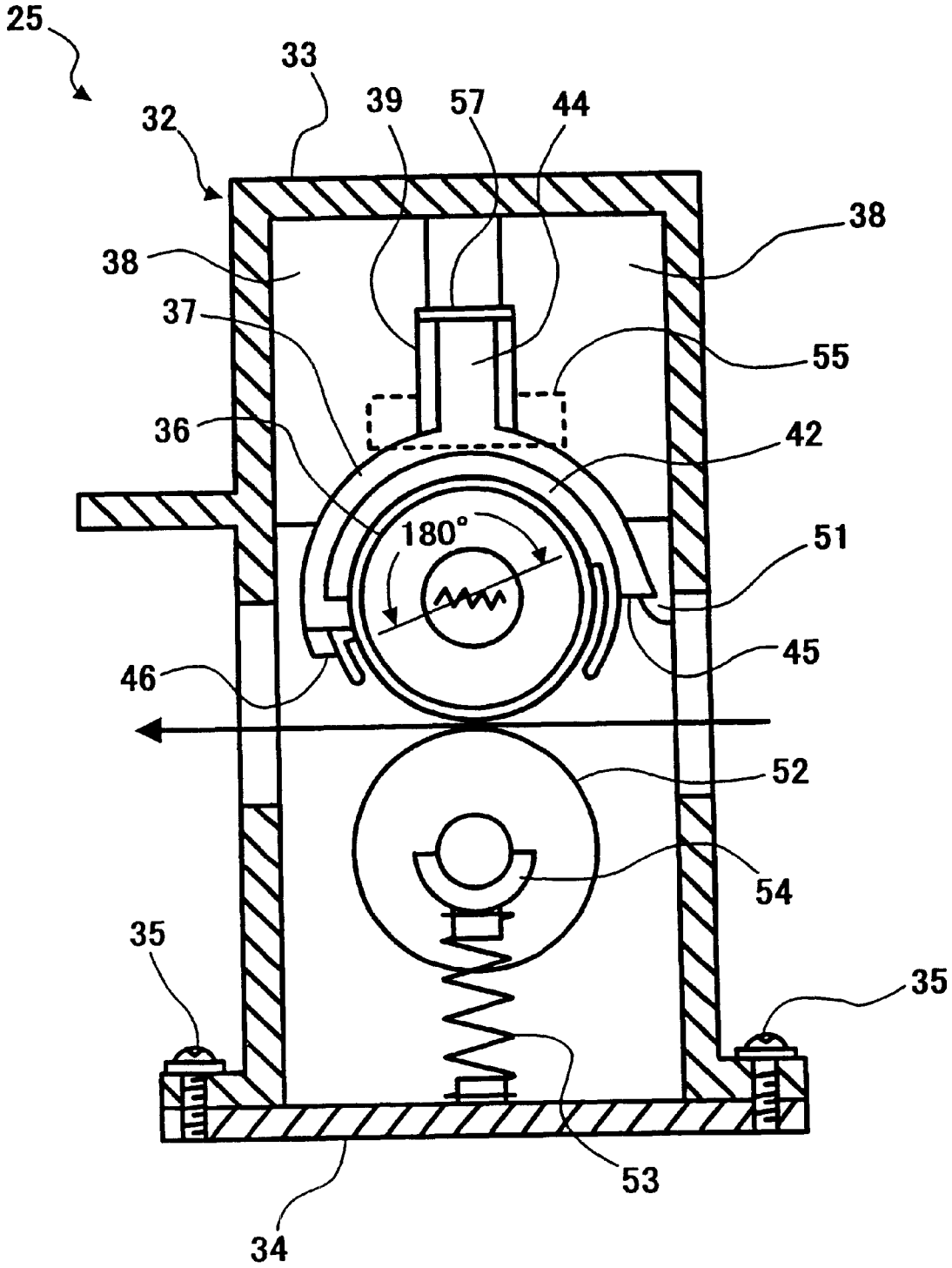
FIG. 2 is a schematic cross-section illustrating how a heat roller is supported at a front side of the fixing device of the present invention.
Figure 3:
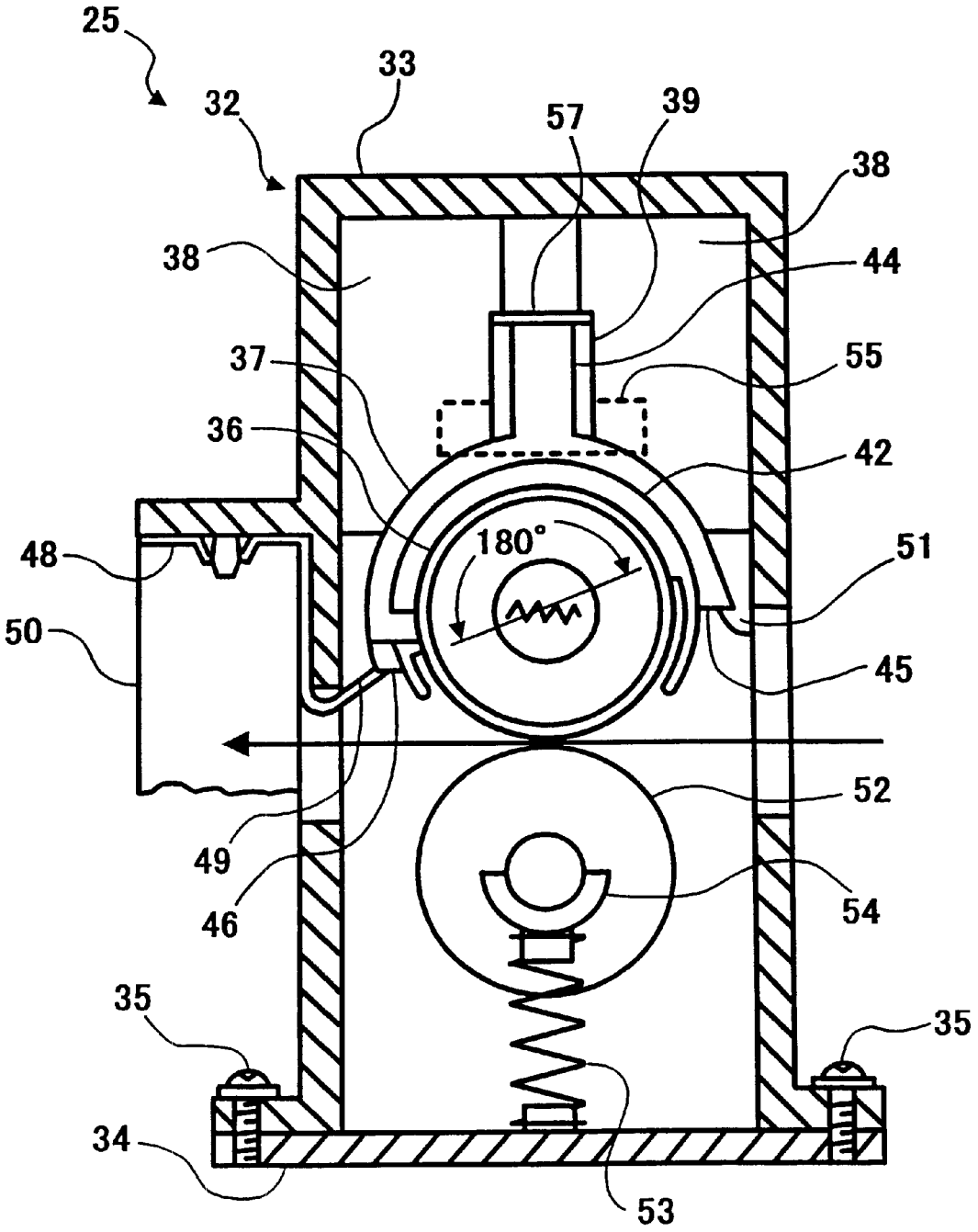
FIG. 3 is a schematic cross-section illustrating how the heat roller is supported at a rear side of the fixing device of the present invention.
Figure 4:
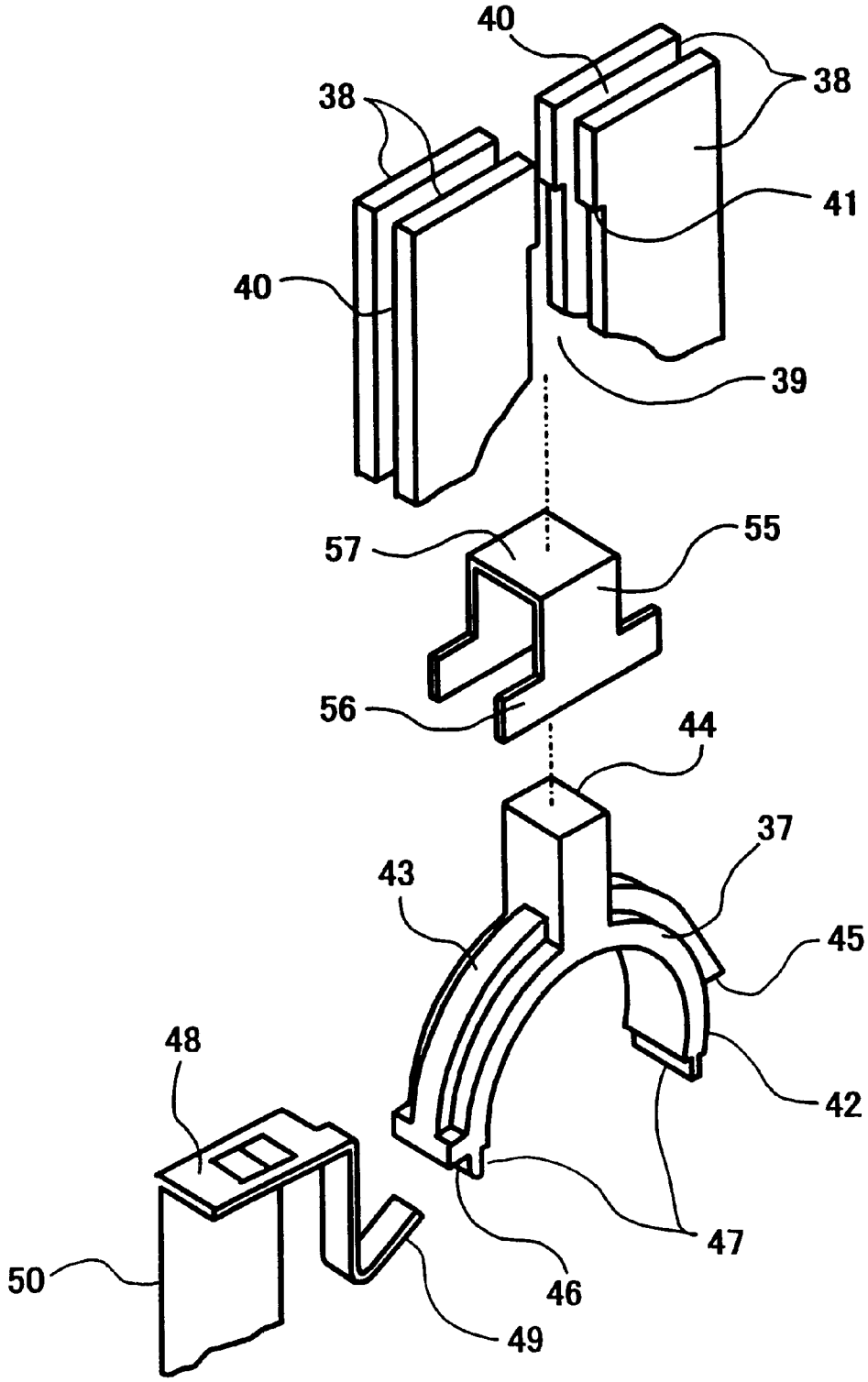
FIG. 4 is a diagrammatical perspective view illustrating how a bearing that supports the heat roller is supported at the rear side of the fixing device of the present invention.
Figure 5:
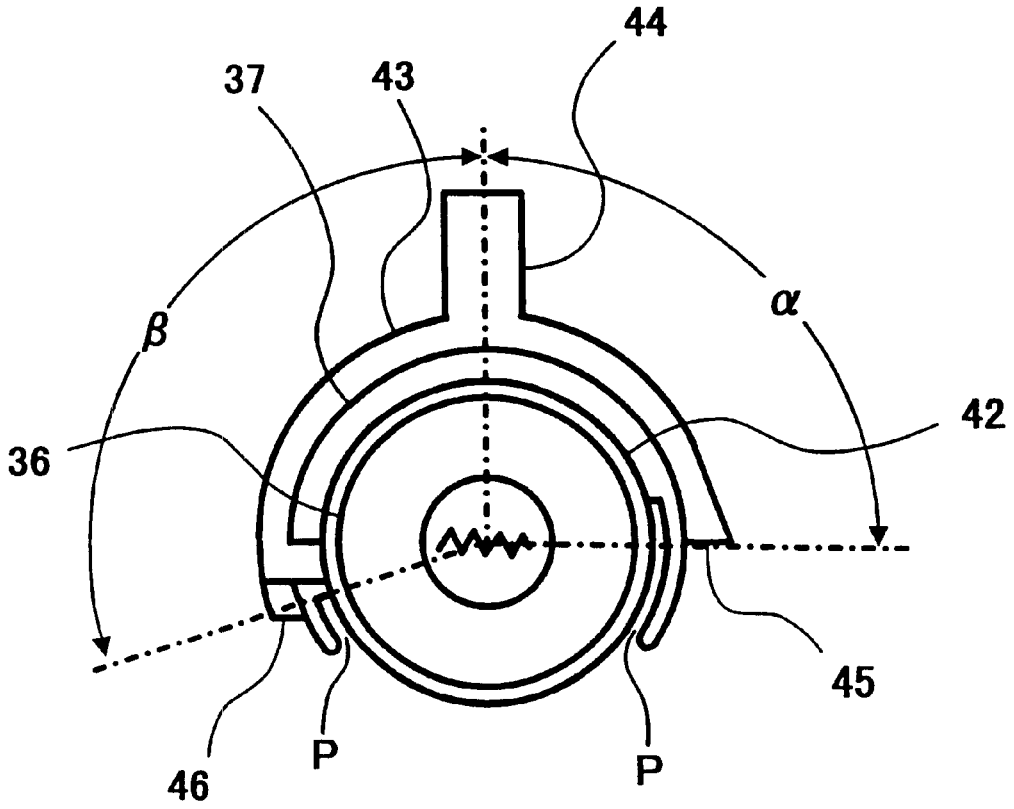
FIG. 5 is a side view illustrating a configuration of the heat roller and the bearing.
Figure 6:
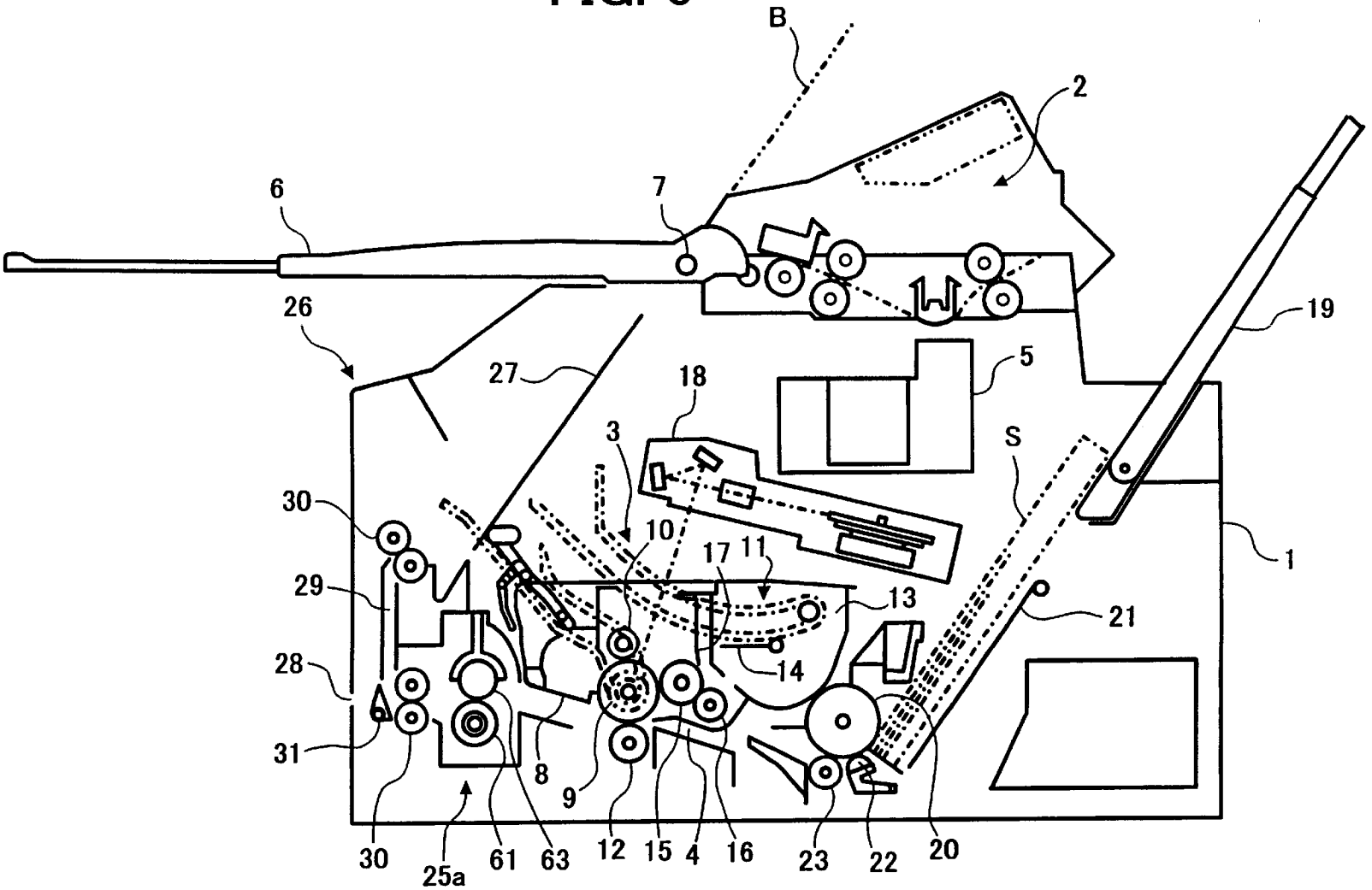
FIG. 6 is a schematic side cross-section illustrating a structure of another embodiment of the image forming apparatus of the present invention.

Referring to FIGS. 2 to 5, a structure of the fixing device 25 is explained hereinbelow. FIG. 2 is a schematic cross-section illustrating how the heat roller 36 is supported at a front side of the fixing device 25. FIG. 3 is a schematic cross-section illustrating how the heat roller 36 is supported at a rear side of the fixing device 25. FIG. 4 is a diagrammatical perspective view illustrating how a bearing 37 that supports the heat roller 36 is supported at the rear side of the fixing device 25. FIG. 5 is a side view illustrating a configuration of the heat roller 36 and the bearing 37.

In FIG. 2, a housing 32 of the fixing device 25 is formed by connecting an upper housing 33 and a lower housing 34 with a screw 35. The lower housing 34 is affixed to a bottom of the main body 1 of the image forming apparatus such that a lower part of the lower housing 34 is fixed to the main body 1 of the image forming apparatus by a screw (not shown).

The bearing 37 by which both ends of the heat roller 36, whose outer circumferential surface is made of metal are supported is provided in the upper housing 33. The bearing 37 having a C-shape supports an upper half of the circumferential surface of an end of the heat roller 36 and is made of a synthetic resin such as PPS (polyphenylene sulfide). A plurality of ribs 38 that support the bearing 37 are formed at both sides of the upper housing 33. As illustrated in FIG. 4, the ribs 38 are located so as to face each other in a conveying direction of the transfer sheet S (indicated by arrows in FIGS. 2 and 3). An inserting part 39 in which a projection 44 is inserted between the ribs 38. In addition, gaps 40 are formed in the ribs 38. At an edge of the ribs 38 that face each other in a conveying direction of the transfer sheet S, steps 41 are formed adjacent to the inserting parts 39.

The bearing 37 is made of material having good resistance to heat, and elasticity to some degree, such as PPS (polyphenylene sulfide). Carbon is contained in the material to impart electroconductivity. The bearing 37 has a C-shaped part 42 having a radial angle of slightly larger than 180° by which the upper side of the circumferential surface of each end of the heat roller 36 is rotatably supported. In addition, the bearing 37 has a rib 43 formed at an outer circumferential surface of the C-shaped part 42 and the projection 44 that upwardly projects from a middle of the rib 43.

The width of the rib 43 is set so as to fit into a gap 40 of the rib 38 as shown in FIG. 4. Steps 45 and 46 are formed at both ends of the rib 43. A cave 47 is formed at each end of the inner surface of the C-shaped part 42 such that the heat roller 36 can be easily inserted into the inner surfaces of the C-shaped part 42.

Two points P illustrated in FIG. 5 indicate both terminals of the contact area of the inner surface of the C-shaped part 42 with the outer surface of the heat roller 36. A distance between two points P is set to a value slightly smaller than the outer diameter of the heat roller 36 when the heat roller 36 is not inserted into the C-shaped part 42. That is, when the heat roller 36 is fit into the bearing 37 while elastically expanding the distance between the both ends of the C-shaped part 42, the heat roller 36 is held so as not to be separated from the bearing 37 because the bearing 37 slightly tightens the heat roller 36 due to the elasticity of the bearing 37.

The projection 44 is disposed so that the angle formed by the step 45 is a (90°) and the angle formed by the step 46 is β that is slightly larger than 90°.

As illustrated in FIGS. 3 and 4, a ground plate 48 is provided to flow static electricity stored in the heat roller 36 through the bearing 37 that is electroconductive. The ground plate 48 has an elastic piece 49 capable of being hooked on or detached from the step part 46 of the bearing 37. Also, the ground plate 48 has a ground piece 50 that is grounded to the ground base of the main body 1 of the image forming apparatus. In addition, as illustrated in FIG. 2, a hooking pawl 51 capable of hooked on or detached from the step part 45 of bearing 37 is united in the upper housing 33.

As illustrated in FIGS. 2 and 3, each end of the pressure roller 52 of the fixing device 25 is supported by a movable bearing 54, which is pressed upward by a spring 53 supported by the lower housing 34, such that the pressure roller is movable in a vertical direction in the lower housing 34.

In addition, the fixing device 25 in the first embodiment of the present invention includes a thermostable stopper 55 that allows displacement of the heat roller 36 in a direction toward a thermal fuse 79 (depicted in FIG. 7) (upward in FIG. 2) within a range such that an insulation distance can be maintained to obtain a predetermined insulation strength even when the bearing 37 made of a synthetic resin melts.

Figure 7:
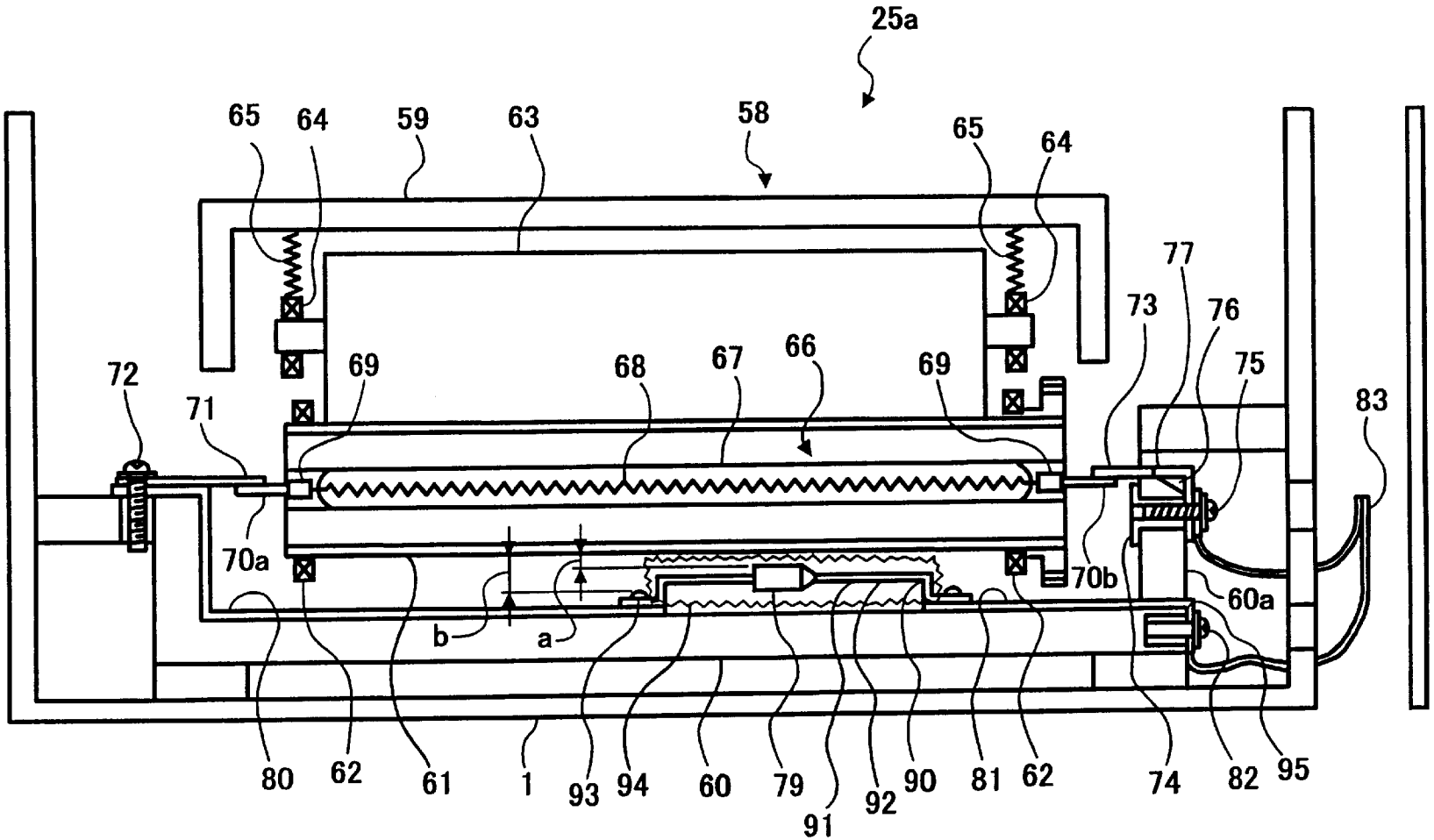
FIG. 7 is a schematic elevational section illustrating a structure of the fixing device of the present invention.

In FIG. 7, an insulation distance "a" between the thermal fuse 79 and a heat roller 61 is set so as to be equal to or more than 4 mm to satisfy European and North American safety standards. However, because the thermal fuse 79 is covered with an insulation tube 92 in this embodiment, as described later, the bearings 62 and the thermal fuse 79 are configured such that an insulating distance "b" between the top of the screw 35 that is electroconductive and is not covered and the heat roller 61 is equal to or more than 4 mm. Accordingly, even when a current flows from an AC power source to the heater 67 and the thermal fuse 79, the heat roller 61 is surely insulated from the thermal fuse 79.

The construction of the thermal fuse 79 is now explained in detail.

A lead wire 91 of the thermal fuse 79 is provided with a leading part 92 that is lead from each end of the thermal fuse 79 along a centerline thereof. The lead wire 91 of the thermal fuse 79 is provided with a folded part 90 that is lead from the leading part 92 and that has a crank-shape folded in a direction separating from the heat roller 61. Further, the lead wire 91 of the thermal fuse 79 is provided with a connecting part 95 that is connected to a circuit (not shown) through a screw 82 and flat-plate shaped conductive members 80 and 81. In addition, the lead wire 91 of the thermal fuse 79 including a folded part 90 is covered with an insulation tube 94.

The stopper 55 is made of a metal plate having elasticity. As illustrated in FIG. 4, the stopper 55 is provided with a nipping part 56 to elastically nip the ribs 38 of the upper housing 33, and a projection 57 that is inserted into the inserting part 39 located between the ribs 38. The stopper 55 does not move toward the thermal fuse 79 even when the bearing 37 melts and the heat roller 36 contacts the stopper 55 by a pressing force of the pressure roller 52 because the end of the projection 57 contacts the steps 41 of the ribs 38. (FIG. 7). Accordingly, an insulation space between the heat roller 36 and the thermal fuse 79 is maintained.

As can be understood from FIG. 4, when the fixing device 25 is assembled, in the above-described configuration, the stopper 55 can be attached to the upper housing 33 by inserting the projection 57 into the inserting part 39 between the ribs 38 formed in the upper housing 33. Namely, the nipping part 56 of the stopper 55 elastically nips the ribs 38 and thereby the stopper 55 does not drop off from the upper housing 33.

Then, the projection 44 of the bearing 37 is inserted into the inserting part 39 of the ribs 38. As illustrated in FIG. 2, the bearing 37 of the front side is hooked on the hooking pawl 51 at the step part 45 of the bearing 37. Accordingly, the bearing 37 of the front side is held by the upper housing 33. At this point, rotation of the bearing 37 of the front side is prevented because the projection 44 is inserted into the inserting part 39. Therefore, even though only one step part 45 is hooked on the hooking pawl 51, the bearing 37 of the front side does not drop off from the hooking pawl 51. In addition, although the bearing 37 is made of synthetic resins having elasticity, i.e. a PPS resin, PPS resin is relatively hard among synthetic resins and therefore cannot be bent largely. However, the projection 44 is separated from the hooking pawl 51, which hooks on the end part (step part 45) of the C-shaped part 42, at an angle of 90° in a circumferential direction. Therefore, the C-shaped part 42 can be hooked on or detached from the hooking pawl 51 without difficulty by bending the end part (step part 45) of the C-shaped part 42 inwardly. At this point, since the C-shaped part 42 is bent while the projection 44 is a base point, the C-shaped part 42 can be bent without causing relatively large stress.

As illustrated in FIG. 3, the bearing 37 of the rear side is attached to the upper housing 33 by hooking the elastic piece 49 of the ground plate 48, which is elastically bent, on the step part 46.

Thereby, the bearing 37 is held in the upper housing 33. In this case, movement of the bearing 37 of the rear side in a circumferential direction is prevented by inserting the projection 44 into the inserting part 39. As a result, the bearing 37 of the rear side is prevented from dropping from the elastic piece 49 even when only one step part 46 is in a state of being hooked on the elastic piece 49 of the ground plate 48.

Then, the heat roller 37 is attached to the upper housing 33 by fitting the heat roller 36 into the bearing 37 while expanding the distance between the both ends of the C-shaped part 42 of the bearing 37 of the front and rear side by elastically bending the both ends thereof. Of course, it is possible that at first the bearing 37 and the heat roller 36 is fit and then the combination is attached to the upper housing 33. When the heat roller 36 is fit into the bearing 37, the relatively long arched part of the C-shaped part 42 is bent in the circumferential direction. Therefore, even when the distance between the two points P, illustrated in FIG. 5, is expanded to such an extent that dimension the distance slightly exceeds the outer diameter of the heat roller 36, a relatively large stress does not occur and the bearing 37 is not broken.

Thereafter, the upper housing 33 to which the heat roller 36 is attached and the lower housing 34 to which the pressure roller 52 is attached are connected by a screw 35. Thus, the fixing device 25 is assembled. In the thus assembled fixing device 25, the heat roller 36 is pressed upwardly by the pressure roller 52. The bearing 37 is secured by being brought into contact with the lower part of the ribs 38 having a semicircular shape. In this state, an inner circumferential surface of the bearing 37 and an outer circumferential surface of the heat roller 36 are kept to be in close contact with each other. The fixing device 25 can be dismantled by operations opposite to the above-described assembling operations.

As illustrated in FIG. 3, when the bearing 37 is attached to the rear side of the upper housing 33, the bearing 37 can be held by bending the elastic piece 49 of the ground plate 48. Also, when the bearing 37 is attached to the front side of the upper housing 33, the hooking pawl 51 of the upper housing 33 is hooked on the end part (step part 45) of the C-shaped part 42. The distance between the both ends of the C-shaped part 42 can be elastically expanded to support the heat roller 36, as illustrated in FIG. 2. Accordingly, in both of these two cases illustrated in FIGS. 2 and 3, there is no need to use a relatively long elastic piece having a hooking part to hook the bearing 37 on the upper housing 33, which is used in background bearings.

Figure 12:
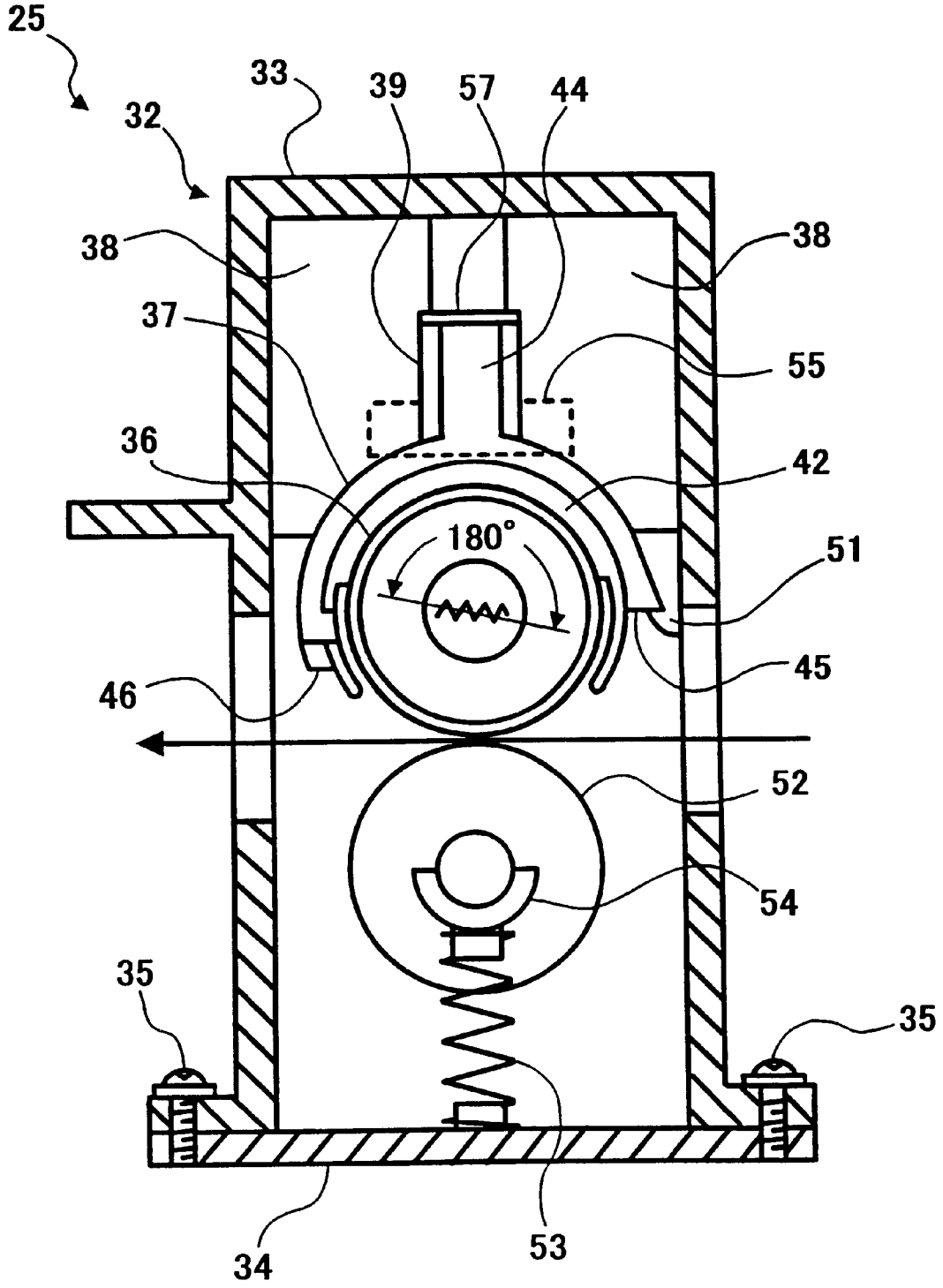
FIG. 12 is a schematic elevational section illustrating another embodiment of the supporting mechanism of the heat roller at the front side of a fixing device in FIG. 2.
Figure 13:
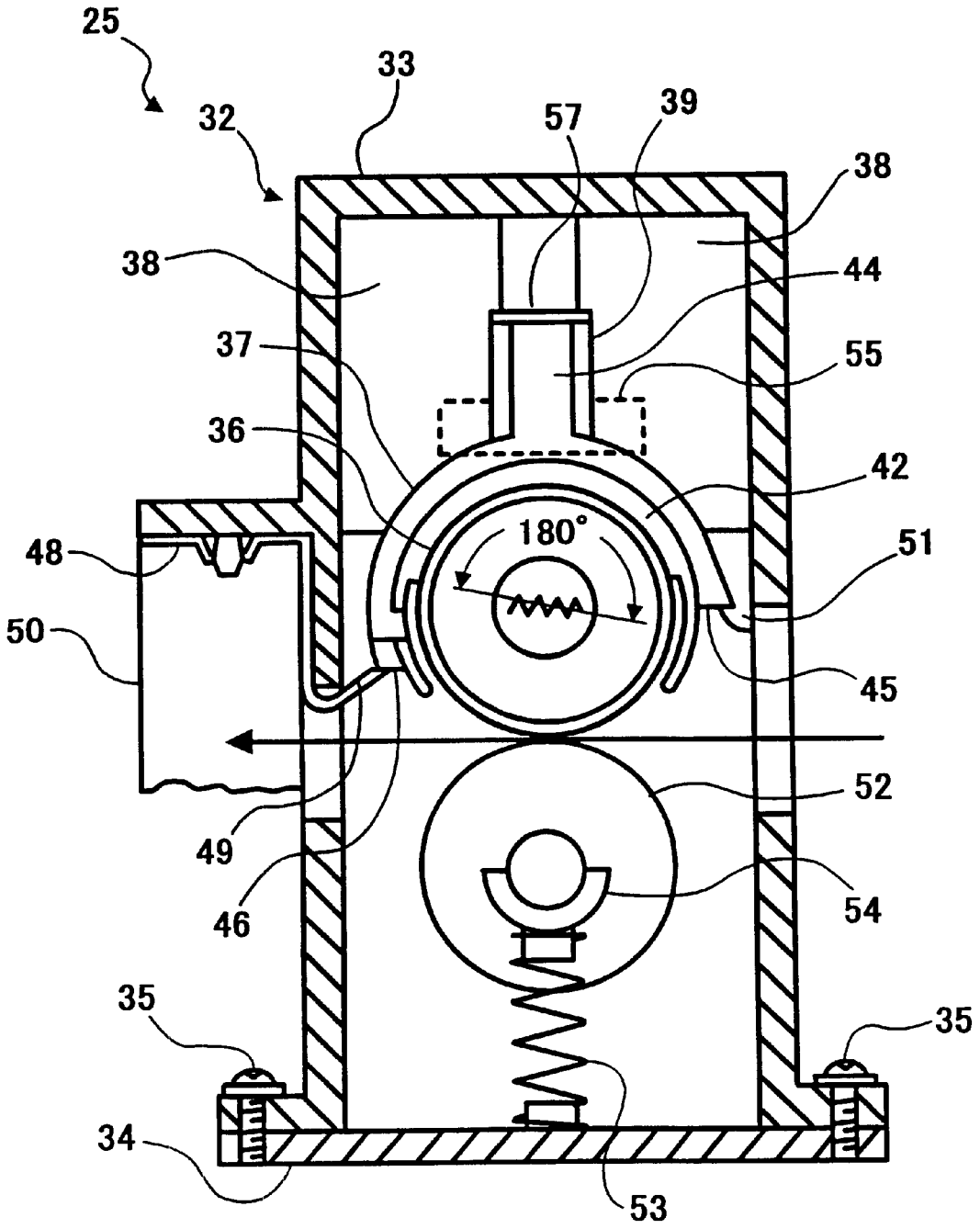
FIG. 13 is a schematic elevational section illustrating another embodiment of the supporting mechanism of the heat roller at the rear side of the fixing device in FIG. 12.

As a result, the amount of the material used in the bearing 37 is decreased and thereby the cost of the materials used for the bearing 37 can be saved. In addition, the two bearings 37 of the rear side and the front side are commonly used in this embodiment. In addition, the radial angle of the contact area of the bearing 37 with the heat roller 36 is set so as to be slightly larger than 180° in this embodiment. However, the angle can be set so as to be less than 180° as illustrated in FIGS. 12 and 13.

The second embodiment of the present invention will be explained referring to FIGS. 6 to 9. The parts substantially the same as those illustrated in FIGS. 1 to 5 are denoted by the same numerals or codes and the description thereof is omitted. A basic construction of the image forming apparatus 1 is the same as that of the first embodiment of the present invention except that the fixing device 25*a* is changed.

The construction of the fixing device 25*a* is described in detail referring to FIG. 7. The fixing device 25*a* has a housing 58, which is fixed on the main body 1 of the image forming apparatus. The housing 58 is connected to upper housing 59 and a lower housing 60 by a screw (not shown). In the lower housing 60, a cylindrical heat roller 61 having openings at both ends is rotatably supported by the bearing 62. Also, in the upper housing 59, a pressure roller 63 is rotatably supported by movable bearings 64 at both ends of the pressure roller 63. The movable bearings 64 are downwardly biased by springs 65. An outer surface of the heat roller 61 and an outer surface of the pressure roller 63 are in pressure contact with each other by the biasing force of the springs 65.

A heater 66 is disposed in the heat roller 61. The heater 66 is provided with a quartz glass tube 67, both ends of which are sealed and in which a heat wire 68 is provided. The heater 66 is also provided with metal foil 69 that is sealed in sealing parts at both ends of the quartz glass tube 67 and connected to the heat wire 68. Also, the heater 66 is provided with lead wires 70*a* and 70*b*, each one end of which is connected to the metal foil 69 and the other end which extends from the respective ends of the quartz glass tube.

At the lead wire 70*a* of the heater 66, a flat-plate shaped heater terminal 71 is welded, and the heater terminal 71 is affixed to the lower housing 60 by a screw 72. At the other lead wire 70*b*, a heater terminal 73 that is bent into an L shape is welded. The heater terminal 73 is affixed to a sidewall part 60*a* of the lower housing 60 by a flanged nut 74 and a screw 75. A flexible space 76 is formed by chamfering a part in the sidewall part 60*a*, which is surrounded by two sides of the L-shaped bent part of the heater terminal 73. The flexible space 76 allows the heater terminal 73 to bend in a direction indicated by an arrow A (FIG. 8) along a longitudinal direction of the heater 66. At this point, the heater terminal 73 bends around a part of the heater terminal 73 such that the part of the heater terminal 73 fixed with the sidewall part 60*a* by the screw 75, is a fulcrum.

Figure 9:
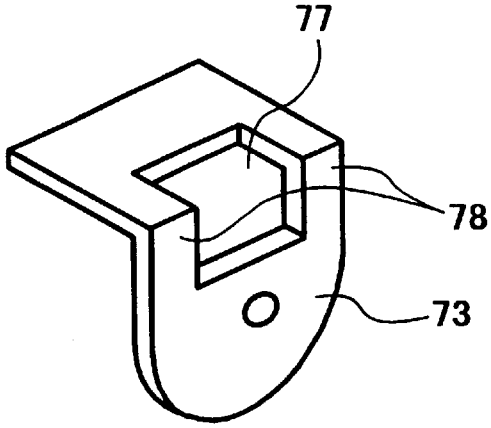
FIG. 9 is a schematic perspective view illustrating the heater terminal.

As shown in FIG. 9, a slit 77 is formed at the L-shaped bent part of the heater terminal 73. By forming the slit 77, flexible parts 78 that cause the heater terminal 73 to be easily bent in the direction indicated by the arrow A are formed at both sides of the slit 77.

Referring again to FIG. 7, plate-shaped conductive members 80 and 81, to which both ends of the thermal fuse 79 are respectively connected, are attached to the lower housing 60. The conductive member 80 is affixed to the lower housing 60 by the screw 72 and is connected to the heater terminal 71 to supply electricity to the heater 66. The other conductive member 81 is affixed to the lower housing 60 by a screw 82. A wire harness 83 to supply electricity is connected to the end of the conductive member 81 affixed by the screw 82 and the affixed part of the heater terminal 73.

In the fixing device having such a construction, the heater 66 generates heat during an image forming operation and the housing 58 (upper housing 59 and lower housing 60) is expanded by heat. The housing 58 is expanded in an outer circumferential direction thereof by heat. The heater terminals 71 and 73, which are affixed to the lower housing 60, are moved in such a direction as separating from the heater 66 by heat expansion of the lower housing 60. With the movement of the heater terminals 71 and 73, a pulling force affects to the lead wires 70*a* and 70*b*, which are connected to the heater terminals 71 and 73, respectively.

Figure 8:
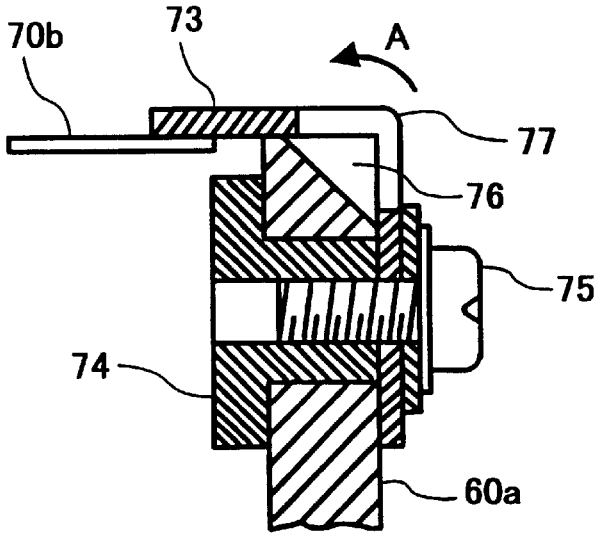
FIG. 8 is a schematic elevational section illustrating how a heater terminal is attached to a lower part of a housing.

Referring to FIG. 8, when the heater terminal 73 is moved in such a direction as separating from the heater 66 by heat expansion of the lower housing 60, the heater terminal 73 is bent in a direction indicated by the arrow A. This is because a flexible space 76 is formed on the sidewall part 60*a* where the heater terminal 73 is attached. Therefore, the amount of movement of the heater terminal 73 of one end of the heater terminal 73 affixed to the lead wire 70*b* becomes relatively small compared with that of the other end of the heater terminal 73 affixed to the sidewall part 60*a*. Thereby, tension that affects the lead wire 70*b* becomes small.

Consequently, the following problems:

1. The heater terminal 73 is disconnected from the lead wire 70*b* at the connection part thereof;
2. The metal foil 69 provided in the quartz glass tube 67 is disconnected from the lead wire 70*b* at the connection part thereof; and
3. The quartz glass tube 67 is cracked thereby damaging the heater 66, can be prevented.

In addition, the heater terminal 73 is configured to bend more easily in the direction indicated by the arrow A because the flexible part 78 is formed in the heater terminal 73.

The flat-plate shaped heater terminal 71 connected to the lead wire 70*a* cannot bend, which is different from the heater terminal 73. However, when the heater terminal 71 moves in such a direction separating from the heater 66 due to the heat expansion of the lower housing 60, the entire heater 66 moves to a heater terminal 71 side because the heater terminal 73 is bent.

Consequently, the following problems:

1. The heater terminal 71 is disconnected from the lead wire 70*a* at the connection part thereof;
2. The metal foil 69 provided in the quartz glass tube 67 is disconnected from the lead wire 70*a* at the connection part thereof; and
3. The quartz glass tube 67 is cracked thereby damaging the heater 66, can be prevented.

In the second embodiment, a flexible part 78 is formed at both sides of the slit 77 that is formed on the heater terminal 73. However, notches can also be formed at both sides of the heater terminal 73 in a width direction thereof to form a flexible part having a relatively narrow width between the notches.

Figure 10:
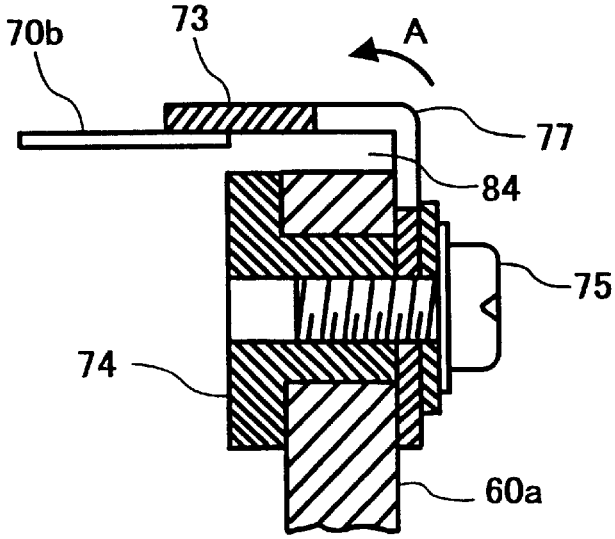
FIG. 10 is a schematic elevational section illustrating how a heater terminal is attached to a lower part of a housing in yet another embodiment of the fixing device of the present invention.
Figure 11:
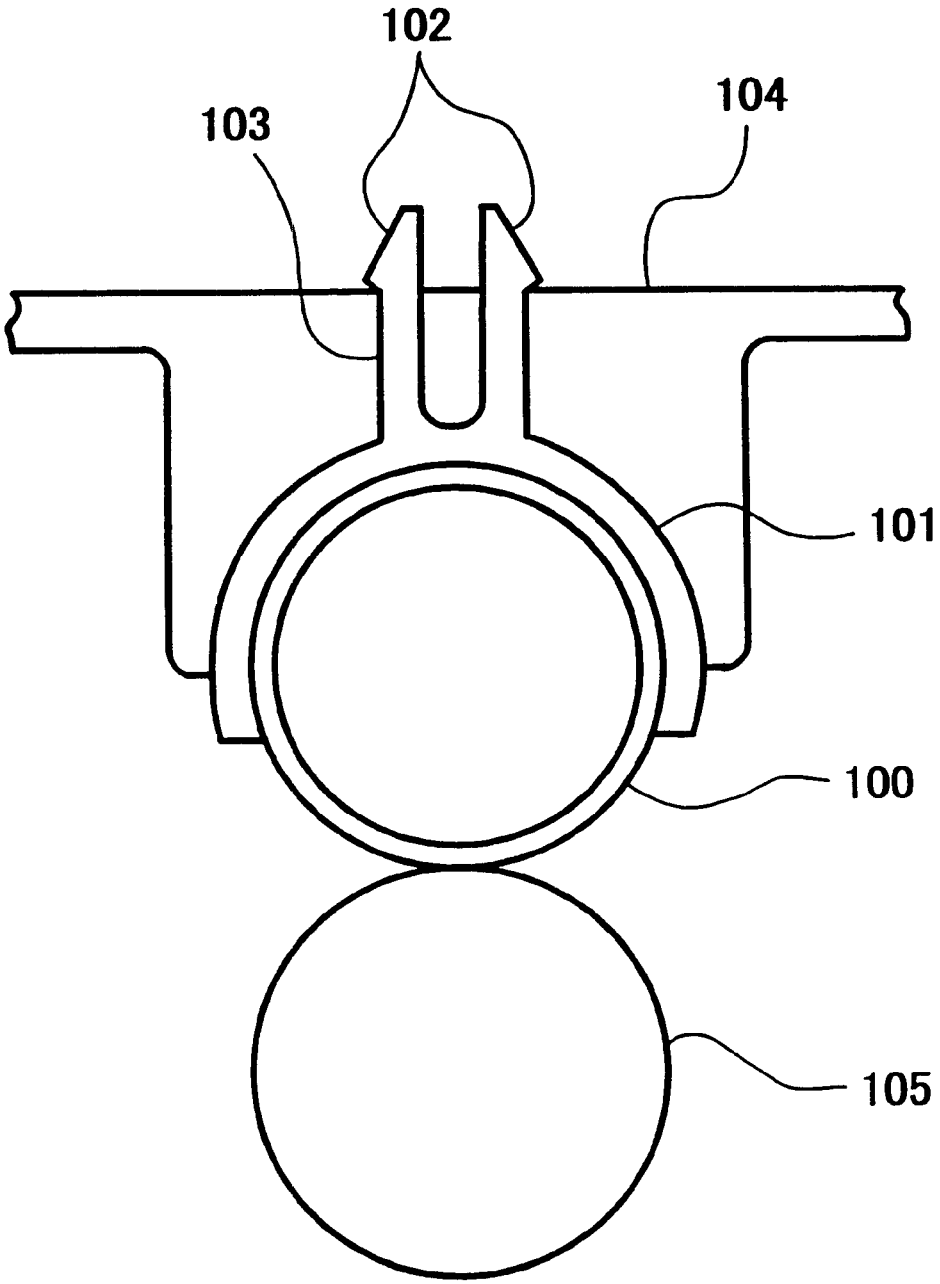
FIG. 11 BACKGROUND ART
FIG. 11 is a schematic side view illustrating a heat roller is supported in background art.

Next, a third embodiment of the present invention is described referring to FIG. 10. The parts substantially the same as those illustrated in FIGS. 6 to 9 are denoted by the same numerals or codes, and the description thereof is omitted.

In this embodiment, when the heater terminal 73 is affixed to the sidewall part 60*a*, the side of the heater terminal 73 folded into an L-shape is separated from an upper end surface of the sidewall part 60*a*. Further, a flexible space 84 is formed between the upper end surface of the sidewall part 60*a* and the heater terminal 73. The flexible space 84 allows the heater terminal 73 to bend in a direction indicated by an arrow A along a longitudinal direction of the heater 66. At this point, the heater terminal 73 bends around a part of the heater terminal 73 such that the part of the heater terminal 73 fixed with the sidewall part 60*a* by the screw 75, is a fulcrum.

Also, in this embodiment, when the heater terminal 73 moves to the direction to separate from the heater 66 by the heat expansion of the lower housing 60, the heater terminal 73 is bent in the direction indicated by the arrow A. This is because a flexible space 84 is formed at the upper part of the sidewall part 60*a* where the heater terminal 73 is affixed. Accordingly, the amount of movement in such a direction as separating from the heater 66 of one end of the heater terminal 73 affixed to the lead wire 70*b* becomes relatively small compared with that of the other end of the heater terminal 73 affixed to the sidewall part 60*a*. Thereby, the tension that affects the lead wire 70*b* becomes small.

Consequently, the following problems:

1. The heater terminal 73 is disconnected from the lead wire 70*b* at the connection part thereof;
2. The metal foil 69 provided in the quartz glass tube 67 is disconnected from the lead wire 70*b* at the connection part thereof, and
3. The quartz glass tube 67 is cracked thereby damaging the heater 66, can be prevented.

Obviously, numerous modifications and variations of the present invention are possible in light of the above teachings. It is therefore to be understood that within the scope of the appended claims, the invention may be practiced otherwise than as specifically described herein.

This document claims priority and contains subject matter related to Japanese Patent Applications Nos. 10-310414, 10-310415, 11-176255, filed on Oct. 30, 1998, Oct. 30, 1998, and Jun. 23, 1999, respectively, and the entire contents thereof are herein incorporated by reference.

What is claimed as new and desired to be secured by Letters Patent of the United States is:

1. A fixing device comprising:

a heat roller including a heater therein;

a housing configured to cover the heat roller;

a lead wire extending from each end of the heater; and a heater terminal fixed to the housing and provided at each end of the lead wire, the heater terminal at at least one end of the lead wire having an attachment portion extending in a direction generally perpendicular to a longitudinal direction of the heater, the attachment portion being fixed to the housing, wherein a flexible space in which the heater terminal is capable of bending along the longitudinal direction of the heater is formed on at least one fixing position of the heater with the housing.

2. The fixing device according to claim 1, wherein a flexible part at which the heater terminal is easily bent along the longitudinal direction of the heater is formed in the heater terminal.

3. The fixing device according to claim 1, wherein the heater terminal at the at least one end of the lead wire is generally L-shaped.

4. The fixing device according to claim 1, wherein the heater terminal at the at least one end of the lead wire has a connection portion connected to an end of the lead wire and joined to the attachment portion, the connection portion extending in a direction generally parallel to the longitudinal direction of the heater.

5. The fixing device according to claim 4, wherein the flexible space is provided between a section of the connection portion and the housing.

6. The fixing device according to claim 5, wherein the flexible space is provided between a section of the attachment portion and the housing.

7. The fixing device according to claim 4, wherein a section of the connection portion abuts the housing.

8. The fixing device according to claim 1, wherein the flexible space is provided between a section of the attachment portion and the housing.

9. An image forming apparatus comprising:

a photoconductor drum configured to be rotated;

an optical writing device configured to form an electrostatic latent image by irradiating an outer circumferential surface of the photoconductor drum with light;

a developing roller configured to develop the electrostatic latent image by supplying toner to the photoconductor drum to form a toner image thereon;

a transfer device configured to transfer the developed toner image on the photoconductor drum onto a transfer sheet; and a fixing device configured to fix the toner image on the transfer sheet, wherein the fixing device comprises:

a heat roller including a heater therein;

a housing configured to cover the heat roller;

a lead wire extending from each end of the heater; and a heater terminal fixed to the housing and provided at each end of the lead wire, the heater terminal at at least one end of the lead wire having an attachment portion extending in a direction generally perpendicular to a longitudinal direction of the heater, the attachment portion being fixed to the housing, wherein a flexible space in which the heater terminal is capable of bending along the longitudinal direction of the heater is formed on at least one fixing position of the heater with the housing.

10. The image forming apparatus according to claim 9, wherein the heater terminal at the at least one of the lead wire is generally L-shaped.

11. The image forming apparatus according to claim 9, wherein the heater terminal at the at least one end of the lead wire has a connection portion connected to an end of the lead wire and joined to the attachment portion, the connection portion extending in a direction generally parallel to the longitudinal direction of the heater.

12. The image forming apparatus according to claim 11, wherein the flexible space is provided between a section of the connection portion and the housing.

13. The image forming apparatus according to claim 12, wherein the flexible space is provided between a section of the attachment portion and the housing.

14. The image forming apparatus according to claim 11, wherein a section of the connection portion abuts the housing.

15. The image forming apparatus according to claim 9, wherein the flexible space is provided between a section of the attachment portion and the housing.

* * * * *